US009700186B2

(12) United States Patent
Moore

(10) Patent No.: US 9,700,186 B2
(45) Date of Patent: Jul. 11, 2017

(54) PORTABLE VACUUMING DEVICE FOR COLLECTING AND NEUTRALIZING FLAMMABLE RESIDUE

(71) Applicant: Alliant Techsystems Inc., Minneapolis, MN (US)

(72) Inventor: Scott E. Moore, Elk River, MN (US)

(73) Assignee: Vista Outdoor Operations LLC, Farmington, UT (US)

( * ) Notice: Subject to any disclaimer, the term of this patent is extended or adjusted under 35 U.S.C. 154(b) by 645 days.

(21) Appl. No.: 14/168,693

(22) Filed: Jan. 30, 2014

(65) Prior Publication Data

US 2015/0208887 A1 Jul. 30, 2015

(51) Int. Cl.
*A47L 7/00* (2006.01)

(52) U.S. Cl.
CPC ..... *A47L 7/0071* (2013.01)

(58) Field of Classification Search
CPC ..... A47L 7/0071; A47L 9/009; A47L 5/28; A47L 9/00; A47L 5/32; A47L 9/242; A47L 9/22; A47L 9/246; A47L 9/1608; A47L 5/24; A47L 7/0004
See application file for complete search history.

(56) References Cited

U.S. PATENT DOCUMENTS 2,452,421 A 10/1948 Ames
4,227,279 A * 10/1980 Tribolet ..... A47L 11/34 15/321
4,268,288 A * 5/1981 Coombs ..... B01D 45/12 15/353
4,284,616 A 8/1981 Solbakken et al.
5,142,730 A 9/1992 Braks et al.
5,466,372 A 11/1995 Jerabek et al.
5,599,365 A * 2/1997 Alday ..... B01D 45/12 55/426
5,623,744 A * 4/1997 Triplett ..... A47L 5/365 15/326
5,867,865 A 2/1999 Obermüller et al.
6,092,667 A 7/2000 Steinmuller et al.
6,251,296 B1 6/2001 Conrad et al.
(Continued)

OTHER PUBLICATIONS

EXAIR Corporation, "How the E-VAC works", accessed Jan. 21, 2014, at: http://www.exair.com/en-US/Primary%20Navigation/Products/Vacuum%20Generators/Pages/How%20the%20E-Vac%20Works.aspx (2 pgs.).

*Primary Examiner* — Robert Scruggs
(74) *Attorney, Agent, or Firm* — Christensen, Fonder, Dardi & Herbert PLLC

(57) ABSTRACT

A vacuuming device for neutralizing flammable powders. The device includes a container having an upper chamber and a lower chamber separated by a baffle, with the upper chamber being in fluid communication with the lower chamber proximate an outer annular region of baffle. A liquid such as water is disposed in the lower chamber, and an air jet drawn into the lower chamber via a vacuum inlet line. In one embodiment, the air jet passes through the liquid for generation of a tangential flow that causes the body of liquid to rotate within the lower chamber. The rotation in the lower chamber can also cause the air in the upper chamber to rotate, so that liquid droplets entrained therein migrate to the outer wall centrifugally. Flammable particles entrained in the air jet are wetted and neutralized.

20 Claims, 10 Drawing Sheets

(56) References Cited

U.S. PATENT DOCUMENTS

| | | | | |
|---|---|---|---|---|
| 6,254,315 | B1 | 7/2001 | Pfeiffer | |
| 6,319,304 | B1 | 11/2001 | Moredock | |
| 6,338,750 | B1 | 1/2002 | Lorini | |
| 6,767,380 | B2 | 7/2004 | von Stackelberg, Jr. | |
| 7,203,994 | B2 | 4/2007 | Smith | |
| 7,267,230 | B1 | 9/2007 | Smith | |
| 8,075,656 | B2 | 12/2011 | Lane et al. | |
| 8,251,228 | B2 | 8/2012 | Clayton et al. | |
| 8,337,580 | B2 | 12/2012 | Manska | |
| 2001/0032812 | A1 | 10/2001 | Morse et al. | |
| 2002/0116783 | A1 | 8/2002 | Giddings et al. | |
| 2005/0108849 | A1* | 5/2005 | Lam | A47L 5/362 15/353 |
| 2006/0265824 | A1* | 11/2006 | Knopow | A47L 11/33 15/27 |
| 2009/0031932 | A1 | 2/2009 | Mori et al. | |
| 2010/0132317 | A1 | 6/2010 | Thien | |
| 2012/0156117 | A1 | 6/2012 | Hoce | |
| 2013/0098405 | A1 | 4/2013 | Boltus | |

* cited by examiner

PORTABLE VACUUMING DEVICE FOR COLLECTING AND NEUTRALIZING FLAMMABLE RESIDUE

BACKGROUND

In certain industrial settings, such as the manufacturing of munitions and explosives, personnel must occasionally deal with the cleanup of flammable or explosive materials, either due to accidental spilling or because of accumulations that occur during routine operation. One way to deal with the cleanup is to use compressed an to effectively sweep an area or to blow out compartments or crevices where the materials accumulate, followed by a manual collection and eventual neutralization. Each step of the process poses risk to the attendant personnel because of the combustible and/or explosive nature of the materials being handled.

A system that combines and streamlines the cleanup, collection and neutralization of flammable, explosive, or otherwise hazardous materials would be a welcomed addition.

SUMMARY OF THE DISCLOSURE

Various embodiments of the disclosure include a vacuuming device that both collects and neutralizes flammable or otherwise hazardous material in a portable, compact package. Some embodiments generate the vacuum source without the use of a motor or other electrical source in the cleanup location, thereby reducing or eliminating the risk of igniting airborne particulates or vapors. Neutralization of certain materials, such as particulates and powders, can be achieved by thoroughly wetting the material within the portable vacuuming device. Hazards associated with disposal of the collected material can be reduced, as the material is already neutralized. In one embodiment, the vacuum is generated from compressed or "shop" air, readily available in many manufacturing settings.

The surroundings during a cleanup operation can be hazardous, as some of the flammable or explosive material can become airborne, posing both an ignition risk and an inhalation risk. Moreover, we have found that the process of "air sweeping" a large area, such as a manufacturing floor space, can cause accumulation of the hazardous material in hard-to-reach places, such as under low clearance equipment and within crevices. By capturing instead of sweeping the hazardous material, the redistribution of the hazardous material in the hard-to-reach places is largely eliminated.

The general concept can be utilized for neutralizing liquids as well as powders. For applications where the material to be neutralized may be reactive with water, a different non-reactive liquid can be used within the container.

Structurally, in various embodiments, a vacuuming device for neutralizing flammable powders is disclosed that includes a container defining an interior chamber and including a top portion, a bottom portion, and a sidewall portion, the sidewall portion separating the top portion and the bottom portion. A baffle is disposed in the container and suspended over the bottom portion of the container. A vacuum inlet line is in fluid communication with the interior chamber, the vacuum inlet line defining an egress port, the egress port being disposed between the baffle and the bottom portion of the container. In one embodiment, the egress port is arranged for generation of a tangential flow component that is parallel to a face of the sidewall portion. A suction source is in fluid communication with the interior chamber of the container. In one embodiment, the suction source is an eductor.

In one embodiment, the sidewall portion extends upwards from the bottom portion to define an opening, and the top portion comprises a lid that forms a closure over the opening.

The baffle can depend from the top portion of the container, and can have an upper surface that defines a concavity. In one embodiment, the concavity defines a funnel having a mouth at an upper end and a drain aperture at a lower end, wherein the funnel substantially outlines an inverted conical geometry having a base at the upper end and an apex at the lower end. The outline of the inverted conical geometry can be truncated proximate the apex to define the drain aperture. In one embodiment, the baffle defines a peripheral edge, the peripheral edge being radially inset from the sidewall portion to define an annular passage therebetween.

In various embodiments, the vacuum inlet line passes through the top portion and the baffle. The baffle can depend from the lid by connection to the vacuum inlet line. The vacuum inlet line can include an ingress port coupled to a vacuum.

In various embodiments, the suction source is coupled with an interior suction conduit that extends into the interior chamber, the interior suction conduit defining an inlet port, the interior suction conduit being arranged with the inlet port being proximate the sidewall portion of the container, wherein a vector normal to the inlet port includes a tangential component parallel to an inner surface of the sidewall portion.

The vacuuming device can be portable, with the container operatively coupled to a plurality of casters for portability. In one embodiment, the container is a drum. The capacity of the drum has a capacity that is between 1 gallon and 70 gallons inclusive. Some embodiments may be tailored to fall within other capacity ranges, e.g. between 2 gallons to 55 gallons or 5 gallons to 40 gallons.

Certain embodiments disclosed herein embody a method of capturing and neutralizing dry combustibles or powders in a facility is disclosed, the method including providing an air space in a container with a water level therein and positioning an egress port of a vacuum inlet line in the container below the water level. An ingress port is positioned exterior to the container for collection of dry combustibles at an area of the facility. The method further comprises generating a vacuum in the air space sufficient to create a suction at the egress port of the vacuum inlet line such that the combustibles are drawn into the vacuum inlet line and discharged out the egress port below the water level, whereby the dry combustibles are wetted.

The method can also comprise providing a vacuuming device including a container having an upper chamber and a lower chamber separated by a baffle, the upper chamber and the lower chamber being in fluid communication proximate an outer annular region of the baffle, the lower chamber being in fluid communication with a vacuum inlet line that defines an egress port disposed in the lower chamber, the egress port being arranged for generation of a tangential flow along an interior face of the lower chamber. Some embodiments include providing operating instructions on a tangible medium, the operating instructions including disposing a liquid, such as water in the container prior to operation and causing the container to run at sub-atmospheric pressure. The liquid can submerge the egress port. The step of causing the container to run at sub-atmospheric pressure draws a gas stream into the lower chamber of the container to generate an air jet having a tangential flow component that is parallel the interior face of the lower chamber, the tangential flow component causing the liquid to rotate within the lower chamber.

The operating instructions can comprise at least one of removing the lid from the sidewall portion of the container prior to disposing the liquid in the container, replacing the lid onto the sidewall portion of the container after disposing the liquid in the container. The vacuuming device provided can include a fill mark, with the operating instructions further instructing to dispose the liquid in the container prior to operation to a level that is proximate the fill mark. In various embodiments, the gas stream is passed through the liquid to generate bubbles within the liquid.

In one embodiment, the method comprises using an eductor suction source, and wherein the operating instructions further comprise connecting the eductor suction source to a compressed air source and initiating a flow of compressed air through the eductor for causing the container to run at the sub-atmospheric pressure.

DETAILED DESCRIPTION OF THE DRAWINGS

Figure 1:
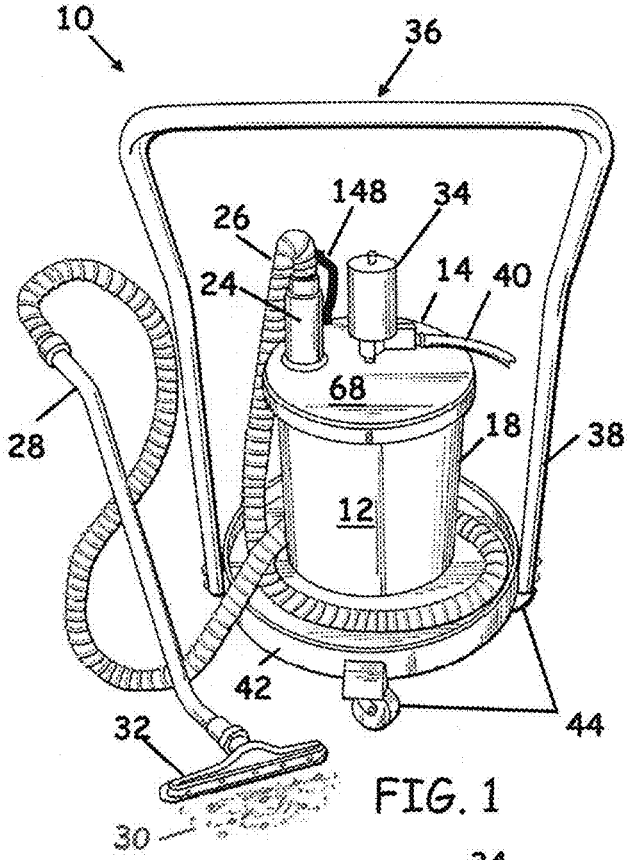
FIG. 1 is a perspective view of a portable vacuuming device in an embodiment of the disclosure.

Referring to FIG. 1, a portable vacuuming device 10 for neutralizing flammable or explosive powders is depicted in an embodiment of the disclosure. The portable vacuuming device 10 includes at container 12 having a top portion 14 and a bottom portion 16 separated by a sidewall portion 18, the container 12 defining an interior chamber 22. The portable vacuuming device 10 can include a vacuum inlet line 24 operatively coupled with a vacuum hose 26 that includes a rigid handling portion 28 fitted with a floor nozzle 32 for collecting residue 30. In one embodiment, the vacuum inlet line 24 passes through the top portion 14 of the container 12. A suction source 34 can be mounted to the container 12 (as depicted) or located remotely and operatively coupled via an external suction line (not depicted). In one embodiment, the suction source 34 is driven by compressed air via a high pressure hose 40 In various embodiments, the container 12 is mounted on a push cart 36 having a handle 38 and tray 42 mounted on casters 44. In one embodiment, the tray 42 can be sufficiently oversized relative to the container 12 to provide stowage for the vacuum hose 26 during storage.

Figure 1A:
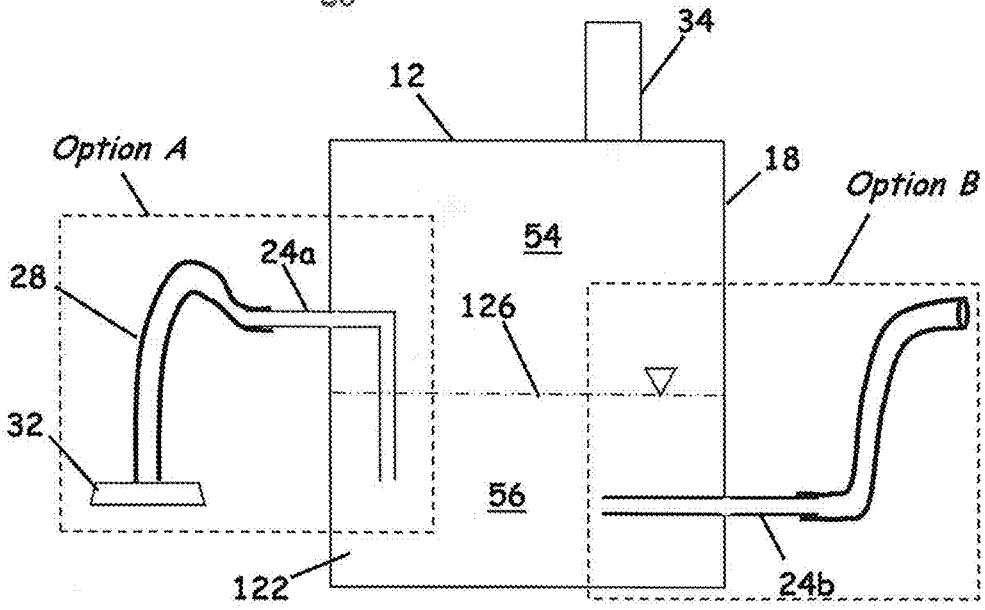
FIG. 1A is a schematic of optional configurations for a device that collects and neutralizes combustible dry products in an embodiment of the invention.

Referring to FIG. 1A, optional arrangements for the routing of the vacuum line are depicted in embodiments of the disclosure. In a first alternative ("Option A"), a vacuum inlet line 24*a* is routed through the sidewall portion 18 above the surface 126 of a quantity of water 122 that occupies a lower chamber 56 of the container 12. In a second alternative ("Option B"), a vacuum inlet line 24*b* is routed through the sidewall portion 18 below the surface 126 of the water 122 that occupies a lower chamber 56. In both configurations, the vacuum inlet line 24*a*, 24*b* defines an egress port 64 that is submersed in the water. The lower chamber 56 and an upper chamber 54 can be, but need not be physically, separated by a barrier, e.g. by a baffle, as discussed below.

Referring to FIGS. 2 through 5, an internal assembly 46 of the portable vacuuming device 10 is depicted in an embodiment of the disclosure. The container 12 can define a central axis 48. A baffle 52 can be disposed in the container 12 and suspended over the bottom portion 16, the baffle 52 defining a boundary between an upper chamber 54 and a lower chamber 56 of the container 12. In one embodiment, the upper chamber 54 is in fluid communication with the suction source 34, and the lower chamber 56 is in fluid communication with the vacuum inlet lire 24.

The vacuum inlet line 24 defines an ingress port 62 exterior to the container 12 and an egress port 64 interior to the container 12, the egress port 64 terminating in the lower chamber 56. In one embodiment, the vacuum inlet line 24 extends through the top portion 14 of the container 12 and the baffle 52, with the egress port 64 being disposed in the lower chamber 56 (i.e., between the baffle 52 and the bottom portion 16 of the container 12). In one embodiment, the vacuum inlet line 24 is formed of a rigid material, such as a metal or resilient polymer, that is rigidly connected to the top portion 14 and baffle 52. In this way, the vacuum inlet line 24 can effectively suspending the baffle 52 above the bottom portion 16 of the container 12. Exterior to the container 12, the vacuum inlet line 24 can be connected to the vacuum hose 26.

In various embodiments, the sidewall portion 18 is substantially cylindrical or frustum-shaped and is integrally formed with the bottom portion 16. The sidewall portion 18 can include an upper edge 64 that defines an opening 66. In one embodiment, the top portion 14 comprises a lid 68 that is configured to form a closure over the opening 66. The lid 68 can closely fit the perimeter of the sidewall portion 18 at the opening 66. The lid 68 can also include a chamfered or radiused interior corner 70 that interfaces with the upper edge 64. Upon evacuation of the interior chamber 22, the chamfered or radiused interior corner 70 exerts a force that is both downward and inward on the upper edge 64. The seal between the upper edge 64 and the lid 68 can be sufficient so that a separate elastomeric seal member is not required.

Figure 4:
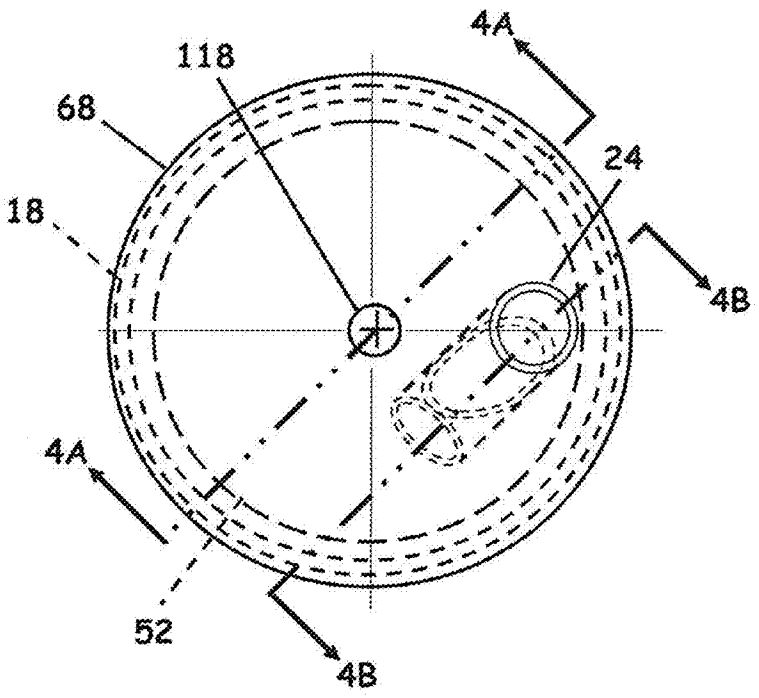
FIG. 4 is a plan view of the lid and baffle assembly disposed in a container in an embodiment of the disclosure.
Figure 4C:
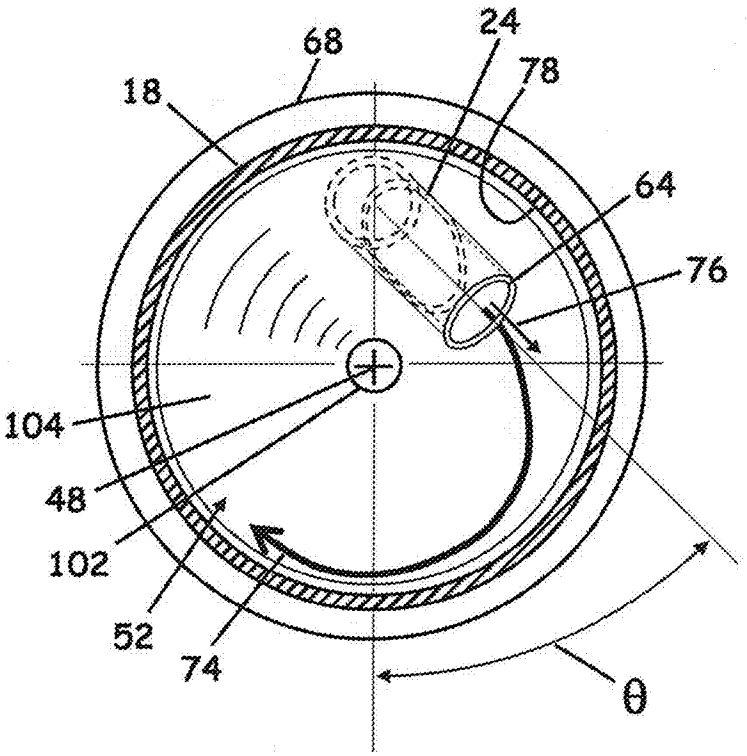
FIG. 4C is an upward sectional view of the lid and baffle assembly disposed in the container of FIG. 4.
Figure 4A:
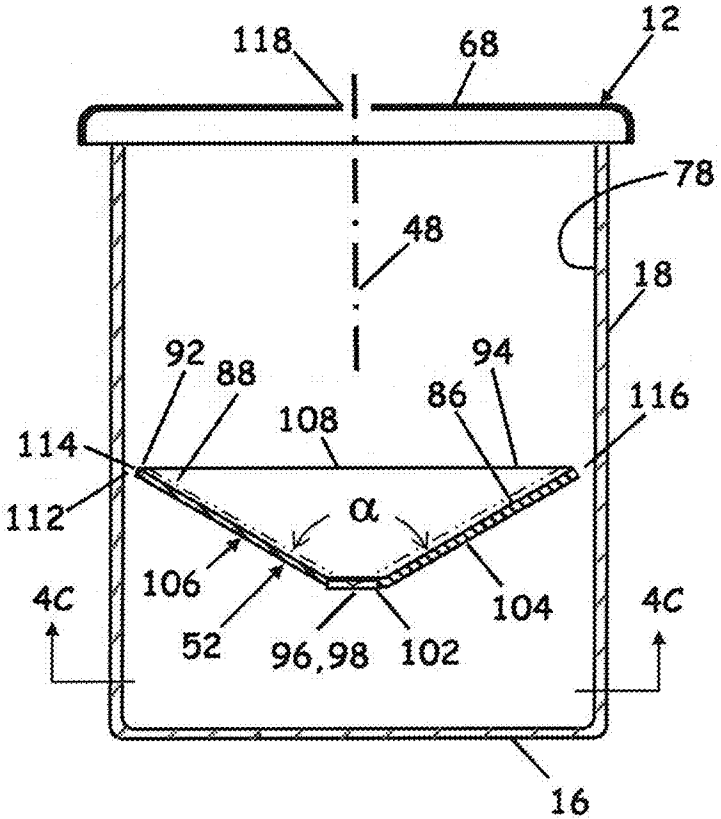
FIGS. 4A and 4B are a sectional elevation views of the lid and baffle assembly disposed in the container of FIG. 4.
Figure 4B:
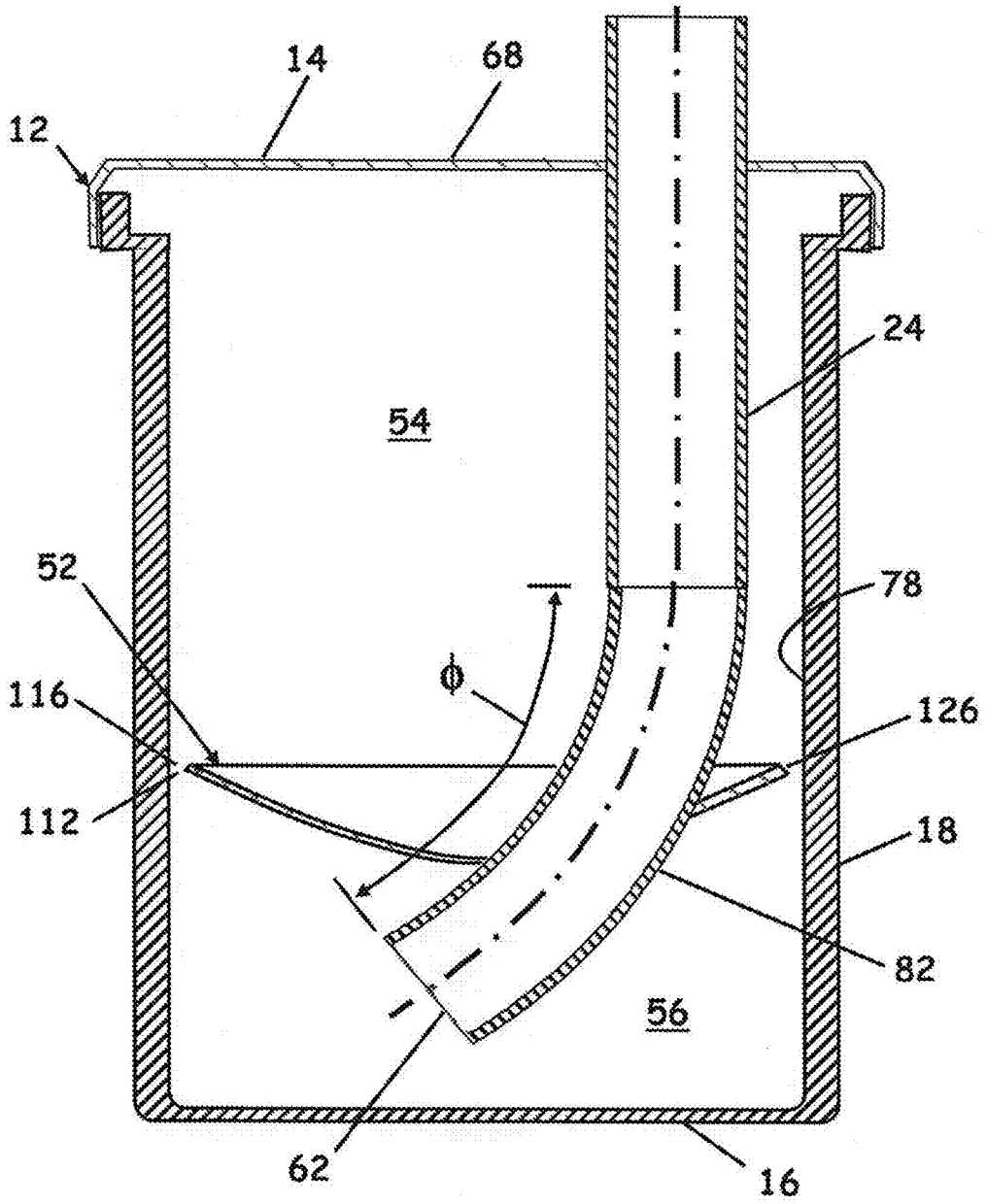

The vacuum inlet line 24 can pass through and be rigidly attached to the lid 68 and the baffle 52 to form a lid-and-baffle assembly 72. The vacuum inlet line 24 can be configured and oriented so that a jet 74 entering the lower chamber 56 via the egress port 64 has a tangential component 76 that is substantially parallel to an inner surface 78 of the sidewall portion 18 and radially offset from the central axis 48 (FIG. 4C). In one embodiment, the vacuum inlet line 24 passes through the top portion 14 and baffle 52 at a location that is proximate the inner surface 78 of the sidewall portion 18, and the vacuum inlet line 24 defines a radiused elbow portion 82 proximate the egress port 64. The vacuum inlet line 24 can be rotated away from the central axis 48 of the container 12 at an angle θ so that the egress port 64 is centered approximately midway between central axis 48 and the inner surface 78 of the sidewall portion 18. In this way, the tangential component 76 can be generated. The jet 74 can also include an axial component 84 (i.e., a component that is parallel to the central axis 48) that is directed towards the bottom portion 16 of the container 12. In one embodiment, the radiused elbow portion 82 defines an angle ϕ from horizontal that ranges between 30° and 90°, and the angle θ ranges between 30° and 70°.

The baffle 52 can be shaped so that an upper surface 86 is concave. In the depicted embodiment, the concave upper surface 86 of the baffle 52 substantially outlines an inverted conical geometry 88 with a base 92 at an upper end 94 and defining an apex 96 at a lower end 98. Also in the depicted embodiment, the apex 96 of the inverted conical outline 88 is truncated to define a drain aperture 102. The concave upper surface 86 can define an angle α.

The baffle 52 can also be shaped so that a lower surface 104 is convex. In the depicted embodiments, the baffle 52 is formed of a uniform thickness component that is formed into the conical or frustum-shaped geometry, thereby providing the concave upper surface 86 and the convex lower surface 104. Thus, for the depicted embodiments, the baffle 52 can be characterized as a funnel-shaped geometry 106 having a mouth 108 at the upper end 94 and the drain aperture 102 at the lower end 98.

In various embodiments, the upper chamber 54 and the lower chamber 56 are in fluid communication via an annular region 112 proximate an outer periphery 114 of the baffle. In one embodiment, the outer periphery 114 is inset from the inner surface 78 of the sidewall portion 18 to define a gap 116 therebetween. In other embodiments (not depicted), the outer periphery of the baffle is in contact with the inner surface 78 of the sidewall portion 18, with fluid communication being provided through apertures or slots formed in the baffle 52 near the periphery 114.

Figure 2:
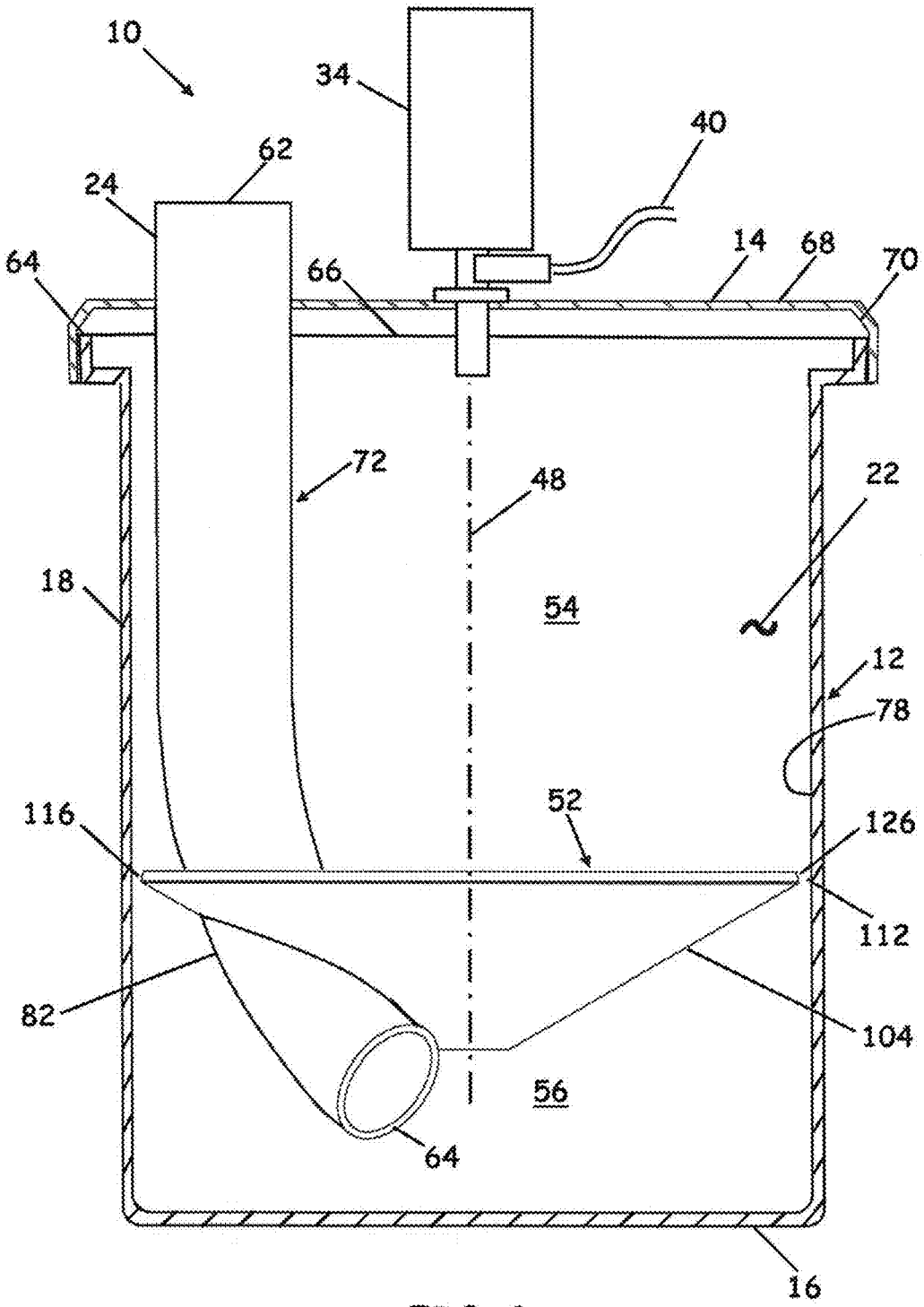
FIG. 2 is a partial sectional view of the portable vacuuming device of FIG. 2 in an embodiment of the disclosure.
Figure 2A:
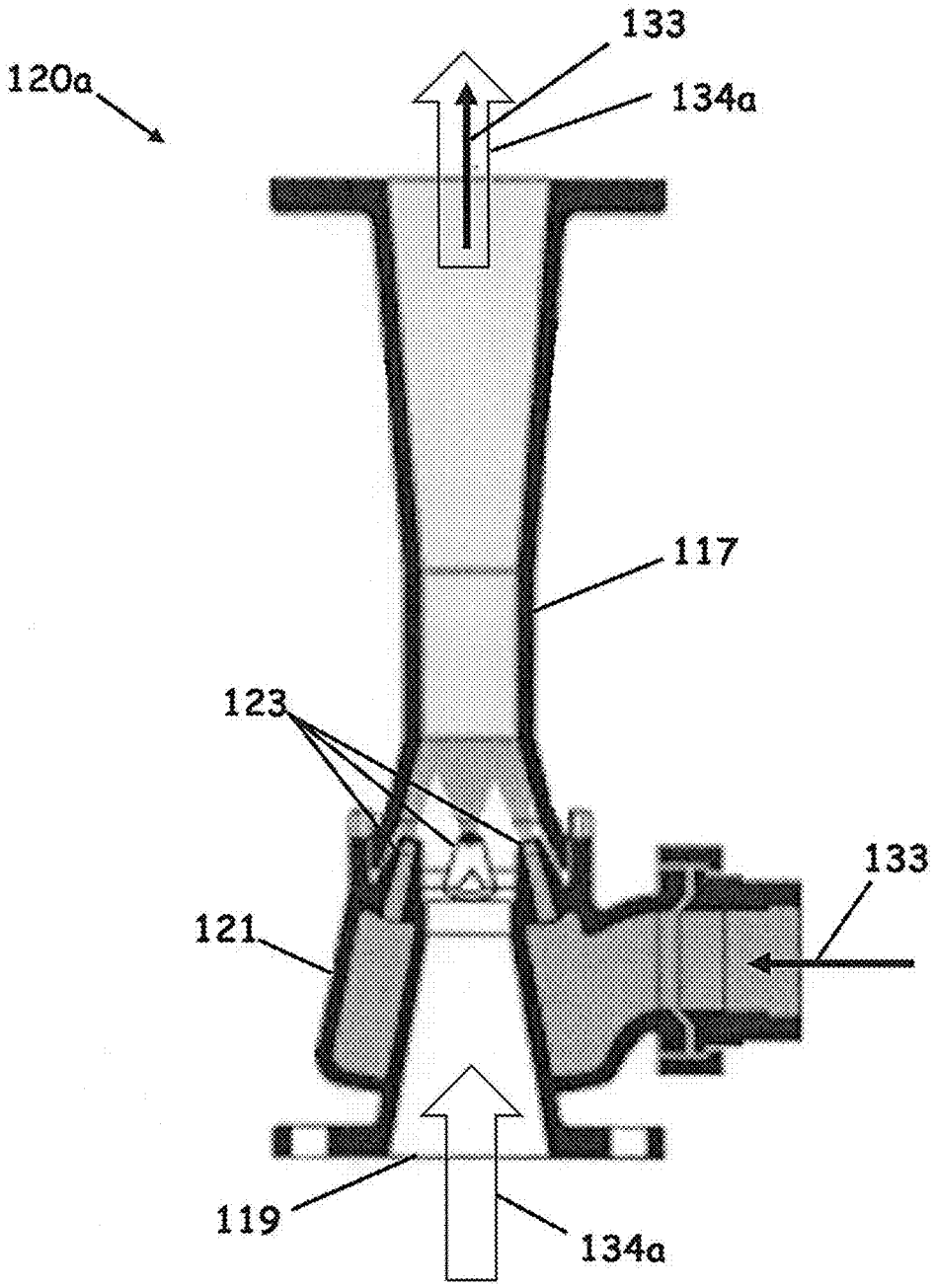
FIG. 2A Prior Art
FIG. 2A is a sectional view of an eductor-driven suction device of FIG. 2.
Figure 3:
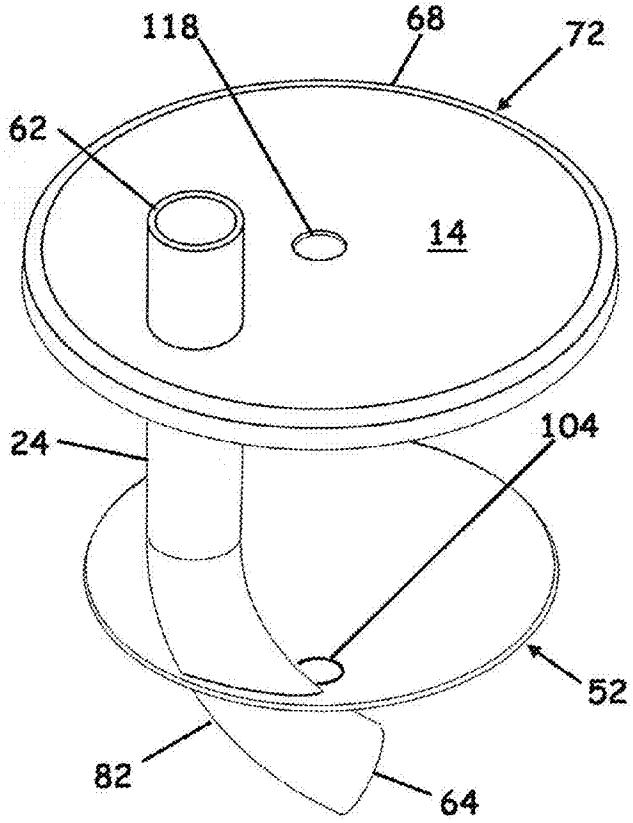
FIG. 3 is a perspective view of a lid and baffle assembly using a vacuum inlet line as a structural support in an embodiment of the disclosure.

The suction source 34 is operatively coupled to a suction port 118 on the container 12. The suction source 34 can be any device known in the art for drawing a vacuum. In one embodiment, the suction source 34 is an eductor device 120, such as a venturi source 120*a* depicted at FIG. 2A. Venturi sources typically include main flow duct 117 having a suction port 119 and in fluid communication with a plenum 121 via one or more flow restrictors 123. The plenum 121 accepts a pressurized gas 133 that is passed through the one or more flow restrictors 121. The static pressure at the exit of the flow restrictors 121 is lower than the pressure at the suction port 119, which causes a suction. The suction port 119, which is fluid communication with the interior chamber 22, draws an exhaust stream 134*a* through the main flow duct 117 for evacuation of the interior chamber 27.

An example of a venturi source is the E-VAC compressed air powered vacuum pump, manufactured by EXAIR Corporation of Cincinnati, Ohio, U.S.A. A description of the operating principle of the E-VAC is available at http://www.exair.com/enUS/Primary%20Navigation/Products/Vacuum%20Generators/Pages/How%20the%20E-Vac%20Works.aspx#relInfo, last visited on Jan. 21, 2014. An advantage of eductor-type suction sources such as the E-VAC is that they can be operated by a remote compressed air source, thereby eliminating any electrical source (such as an electric motor) in the vicinity of the portable vacuuming device 10. The elimination of such electrical sources obviates the suction source 34 as a potential ignition source where flammable or explosive materials are present.

Figure 5B:
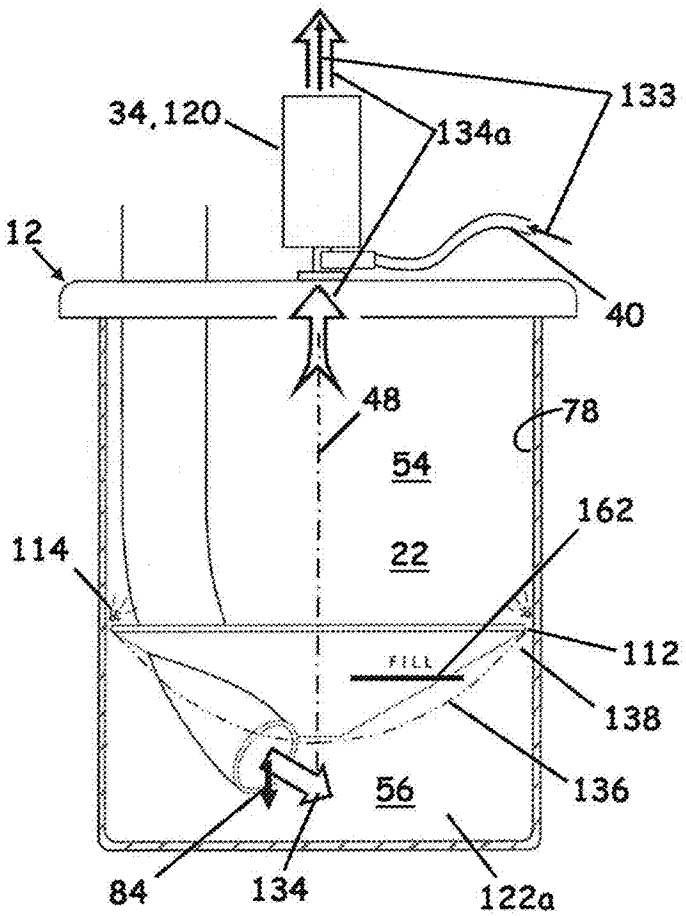
FIGS. 5A and 5B are partial sectional views of the portable vacuuming device of FIG. 2 in operation in an embodiment of the disclosure.
Figure 5A:
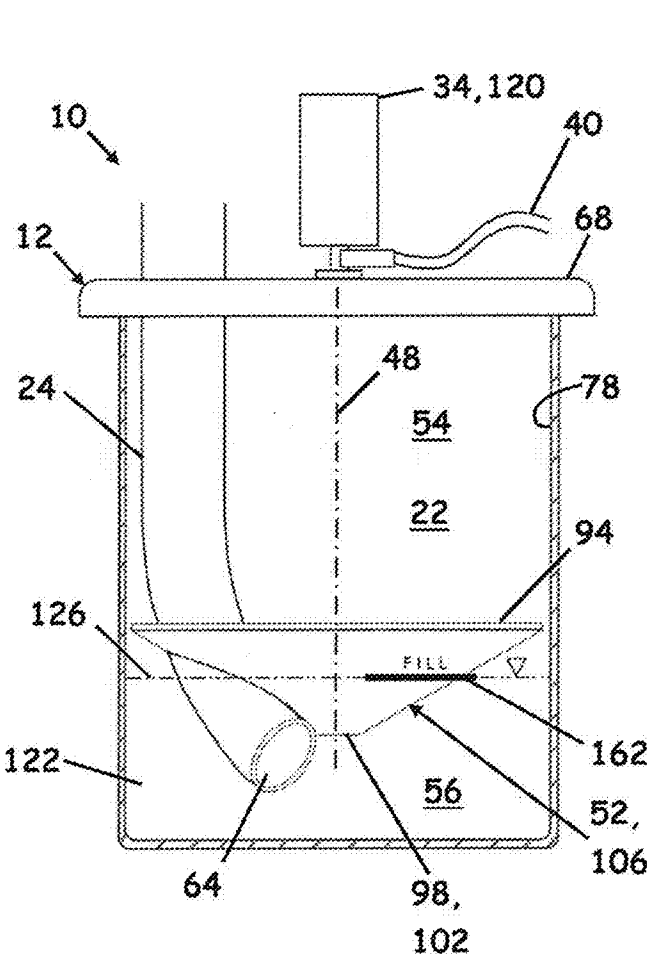
Figure 6:
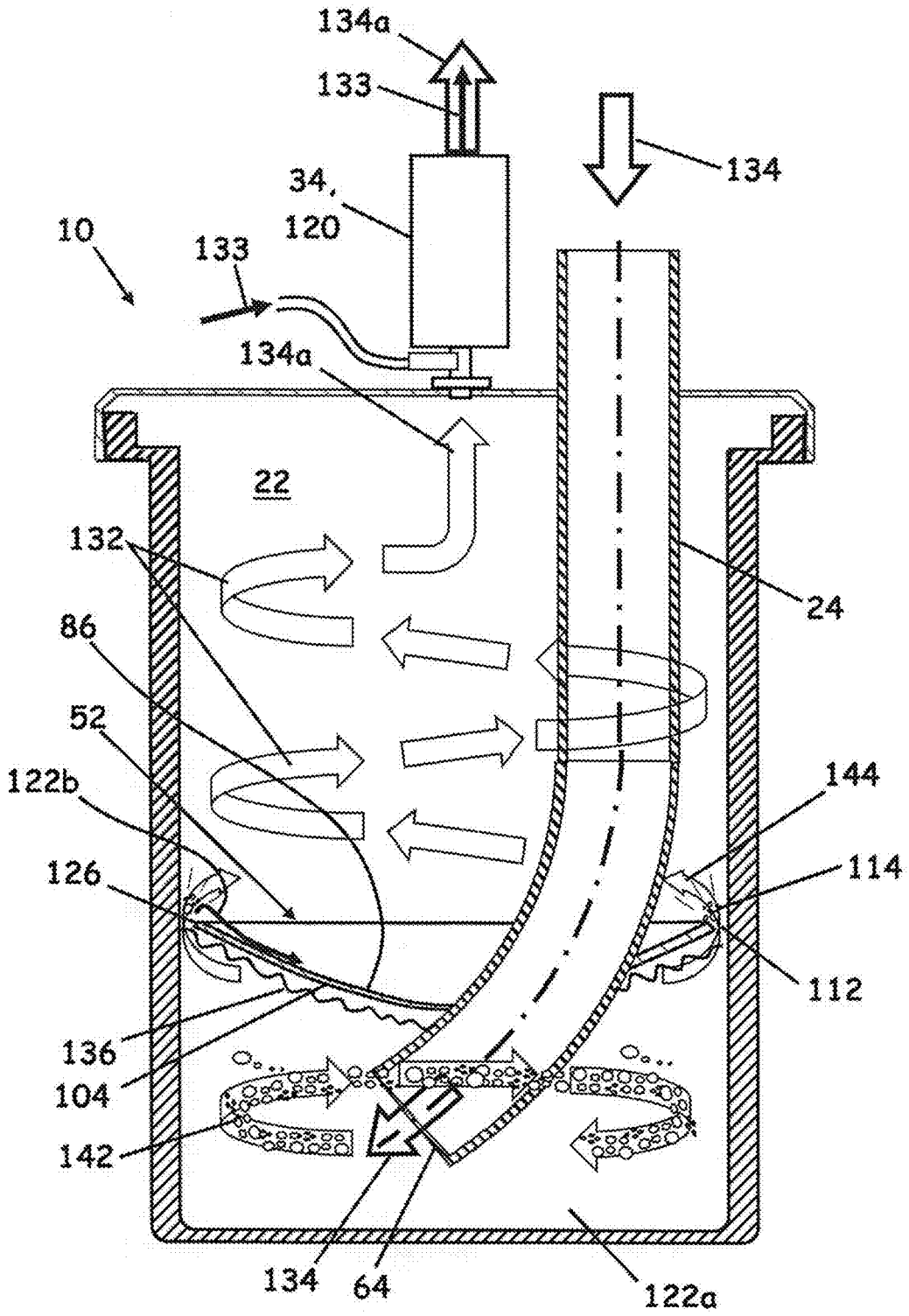
FIG. 6 is depicts the flow of gas through the portable vacuuming device in the view of FIG. 3B during operation in an embodiment of the disclosure.

Referring to FIGS. 5A, 5B, and 6, operation of the portable vacuuming device 10 is described in a disclosed embodiment. A quantity of water 122 is disposed in the lower chamber 56. For embodiments were the baffle 52 defines the funnel-shaped geometry 106, the water 122 can flood the drain aperture 102 so that a surface 126 of the water 122 encroaches the upper chamber 54 when the water 122 is static. The surface 126 of the water 122 can be of sufficient height to cover the egress port 64 of the vacuum inlet line 24. In one embodiment, the water 122 is filled to a fill level 128 that is approximately half way between the upper end 94 and the lower end 98 of the funnel-shaped geometry 106 (FIG. 5A).

Upon activation of the suction source 34, a sub-atmospheric pressure is created in the interior chamber 22 of the container 12. For eductor-type suction sources, activation of the suction source 34 can be attained by application of a pressurized gas 133. The sub-atmospheric pressure causes a gas stream or air jet 134 to enter the lower chamber 56 of the container via the vacuum inlet line 24 and egress port 64. During steady state operation, the air jet 134 that enters the container 12 is also drawn out via the suction source 34 as an exhaust stream 134*a*. In the depicted embodiment, the air jet 134 enters the lower chamber 56 below the surface 126 of the water 122. Because of the orientation of the vacuum inlet line 24 (recall FIG. 4C), the tangential component 76 of the air jet 134 is generated along or parallel to the inner surface 78 of the container 12, which pushes the water 122 in a tangential manner along the inner surface 78 of the container 12 and causes the water 122 within the lower chamber 56 to rotate in a cyclonic manner. The cyclonic motion of the water 122 can cause the water to rise proximate the inner surface 78 of the container 12 and to depress near the central axis 48, with a free surface 136 of the water 122 roughly defining a paraboloid. Herein, the water 122 is identified generally by numerical reference 122 and in rotation by numerical reference 122*a*. In one embodiment, the egress port 64 is located so as to be under the free surface 136 of the rotating water 122*a* during operation and at normal water fill levels.

During operation, a rising edge 138 of the rotating water 122*a* is defined at the interface between the free surface 136 of the rotating water 122*a* and the inner surface 78 of the container 2. In one embodiment, the rising edge 138 approaches and/or encroaches the annular region 112 proximate the outer periphery 126 of the baffle 52. Because of the fluid communication between the upper chamber 54 and the lower chamber 56 in the annular region 112, the rotating motion of the rotating water 122*a* in the lower chamber 56 can cause air in the upper chamber 54 to also rotate in a cyclonic manner to establish a rotating air flow 132 (FIG. 6). The cyclonic effect of the rotating air flow 132 is typically strongest near the annular region 112, where the rotating water 122*a* of the lower chamber 56 interfaces the rotating air flow 132 of the upper chamber 54.

The air jet 134, being injected into the water 122, can entrain a coarse, turbulent stream of air bubbles 142 within the rotating water. The air bubbles 142 rise and break the free surface 136 of the rotating water 122, causing the free surface 136 of the rotating water 122 to spray against the lower surface 104 of the baffle 52. For embodiments where the lower surface 104 of the baffle 52 is convex, such as the funnel-shaped geometry 106 depicted in FIGS. 1 through 7, the air that escapes the free surface 136 of the rotating water 122 can be channeled upwards along the convex lower surface 104 of the baffle 52 and enter the upper chamber 54 of the container 12 via the annular region 112 proximate the outer periphery 126 of the baffle 52.

In one embodiment, the quantity of the water 122 in the lower chamber 56 is such that the rising edge 138 of the rotating water 122 encroaches the upper chamber 54 via the annular region 112 proximate the outer periphery 126 of the baffle 52. Air 144 entering the upper chamber 54 through the annular region 112 thus percolates through the rising edge 138, which can cause water in or near the annular region 112 to spray against the inner surface 78 of the container 12 in the upper chamber 54 and mist droplets 114 to become entrained in the rotating air flow 132 of the upper chamber 54.

In still another embodiment, the quantity of the water 122 in the lower chamber 56 is such that there is no "free surface" when the water rotation is at full speed. In this embodiment, the water is in contact with the lower surface 104 of the baffle 52, the contact being temporally interrupted by the air bubbles 142 that migrate to the interface of the water 122 and the lower surface 104 of the baffle 52. By this mechanism, the lower surface 104 of the baffle 52 is effectively scrubbed by the rotating water 122. In this embodiment, the rising edge 138 can cause a portion 122*b* of the rotating water 122*a* to spill over the outer periphery 126 of the baffle 52. For embodiments employing a baffle 52 with a concave upper surface 86 and a drain aperture 102, the water 122 that spills over the outer periphery 126 of the baffle 52 cascades down the concave upper surface 86 and can re-enter the lower chamber via the drain aperture 102.

Air 144 entering upper chamber 54 through the annular region 112 proximate the outer periphery 126 of the baffle 52 percolates through the water 122*b* that is spilling over the outer periphery 126, which can cause the water in the annular region 112 to spray against the inner surface 78 of the container 12 in the upper chamber 54 and mist droplets 114 to become entrained in the rotating air flow 132 in the upper chamber 54. Also, if any froth is formed by the turbulent interaction between the air bubbles 142 and the rotating water 122 or by the interaction between the rotating water 122 and the inner surface 78 and/or baffle 52, the froth can be collected within the concave upper surface 86 for settling back into liquid form.

The mist droplets 114 that are generated in the annular region 112 proximate the outer periphery 126 of the baffle 52 and become entrained in the rotating air flow 132 in the upper chamber 54 tend to migrate radially outward from the central axis 48 due to the centrifugal force caused by the rotating air flow 132. In this way, the mist droplets 114 can be deposited on the inner surface 78 of the container 12 in the upper chamber 54.

By the various spraying, spilling, scrubbing, and centrifugal mechanisms described above, the various surfaces 78, 86, 104 that define the boundaries of and within the interior chamber 22 tend to be wetted during operation of the portable vacuuming device 10. Water that collects on the inner surface 78 of the container in the upper chamber 54 cascades downward and re-enters the water 122 of the lower chamber 56 near the annular region 112 proximate the outer periphery 126 of the baffle 52.

The air bubbles 142 that are initially formed during entrainment of the air jet 134 in the water 122 can carry flammable or explosive dry particles within. Some of the particles, particularly finer powders of micrometer and nanometer size, can ride within the bubbles 142 without becoming wetted, and initially escape the bubbles 142 without being neutralized. The wetting and subsequent neutralization of the escaping dry particles is facilitated several ways. Consider that the lower surface 104 of the baffle 52 can serve as a wetted barrier that breaks up larger diameter bubbles into smaller diameter bubbles, thereby increasing the chances of any particulates resident therein of becoming wetted. Also, any particulates that somehow course along the wetted lower surface 104 of the baffle 52 and/or percolate through the annular region 112 proximate the outer periphery 126 of the baffle 52 without becoming wetted tend to become entrained in the rotating air flow 132 of the upper chamber 54. The particles, being denser than air, are subject to the same centrifugal forces as the mist droplets 114, and tend to migrate radially outward to collide with the wetted inner surface 78 of the container 12 and become neutralized. The collecting moisture on the inner surface 78 also tends to trickle downwards, effectively washing the residue that results from the particles mixing with the water of the wetted inner surface 78, for eventual re-entry into the lower chamber 56.

The container 12, lid 68, baffle 52 and vacuum inlet line 24 can variously comprise metallic and polymeric materials. For certain applications, prevention of any electrical static discharge is desired. Accordingly, in various embodiments, the lid 68, baffle 52 and vacuum inlet line 24 are electrically conductive (e.g., fabricated from metal). The electrically conductive materials and the intimate contact between the water 122 and the inlet line maintains the components within the container 12 at the same electrical potential. In one embodiment, the vacuum hose 26, rigid handling portion 28, and floor nozzle 32 are comprised of electrically conductive materials and are in intimate contact with each other to maintain the same electrical potential therebetween. In one embodiment, a grounding strap 148 is connected between the vacuum hose 26 and the vacuum inlet line 24 or the lid 68 to assure the vacuum hose 62, rigid handling portion 28, and floor nozzle 32 are at the same electrical potential as the container components. It is noted that a uniform electrical potential throughout the portable vacuuming device 10 can be maintained, even where the sidewall portion 18 and the bottom portion 16 of the container 12 are of an electrically non-conductive material (e.g. a polymer).

For applications where electrical sparking is a concern, the conductive materials should be non-sparking. Examples of "non-sparking" materials include copper-aluminum alloys (aluminum bronze), brass, bronze, MONEL metal (copper-nickel alloy), and copper-beryllium alloys (beryllium bronze). Such materials have the desired electrically conductive characteristics, but do not generate sparks under friction or abrasion.

Figure 7A:
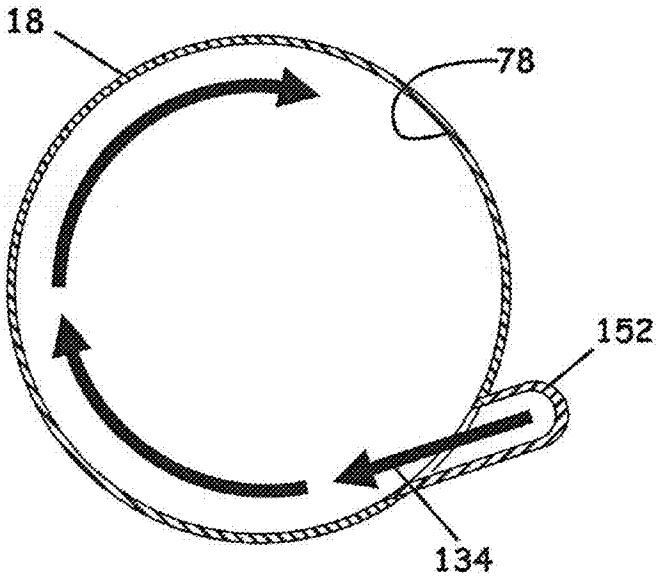
FIG. 7A is a bottom sectional view of the portable vacuuming device of FIG. 7.
Figure 7:
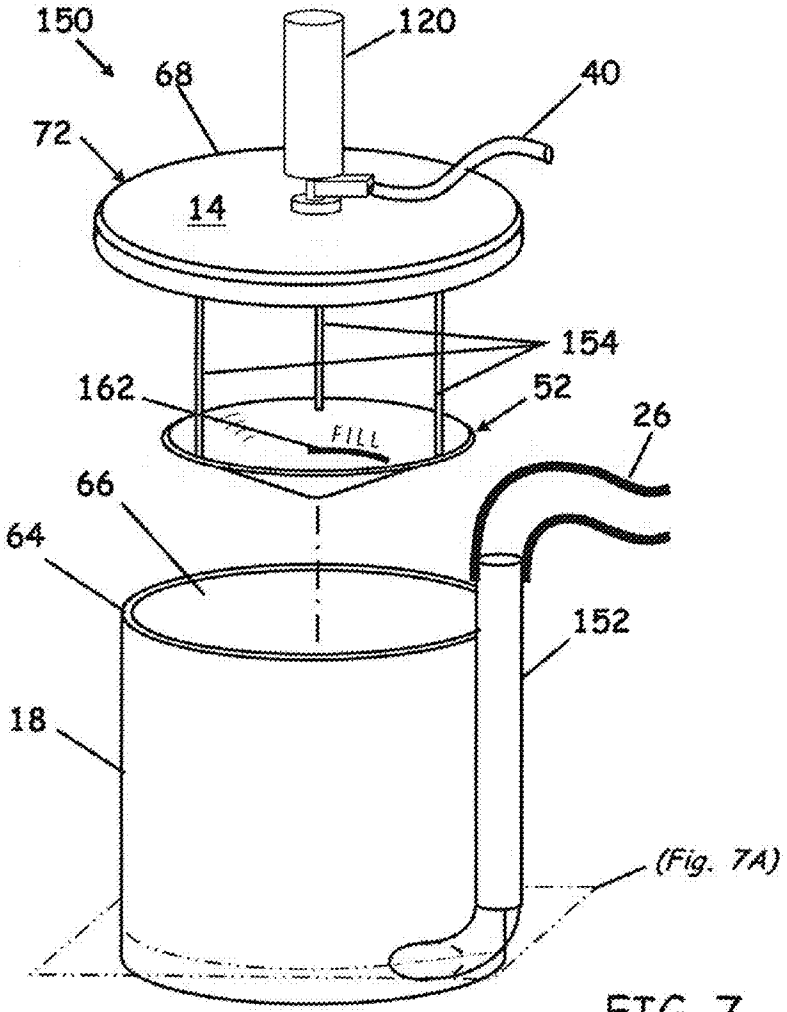
FIG. 7 is an unassembled view of a portable vacuuming device with a side-mounted vacuum inlet line in an embodiment of the disclosure.

Referring to FIGS. 7 and 7A, a portable vacuuming device 150 having a side-mounted vacuum inlet line 152 is depicted in an embodiment of the disclosure. The portable vacuuming device 150 can include many of the same aspects as the portable vacuuming device 10, identified by like-numbered numerical references in FIGS. 7 and 7A. The side-mounted inlet 152 introduces the air jet tangentially along or parallel to the inner surface 78 of the container 12. The baffle 52 can be suspended from the top portion 14 of the container 12 using one or more struts 154. In operation, the portable vacuuming device 150 can function and perform in essentially the same manner as the description attendant to FIGS. 5B and 6.

Procedurally, for the embodiment depicted in FIGS. 1-6 and FIGS. 7 and 7A, the water 122 can be deposited in the container 12 by removing the lid-and-baffle assembly 72 and filling the water 122 to a fill mark 162 that establishes a desired level for the fill level 128. In one embodiment, the container 12 is of a sufficiently translucent material such that the fill level 128 inside the container and the fill mark 162 can be visually compared from outside the container 12 (FIGS. 5A and 5B). In other embodiments, the fill mark 162 is disposed on the inner surface of the container 12 for inspection by removing the lid-and-baffle assembly 72.

In other embodiments (not depicted), the baffle 52 can be detached from the lid 68, and be suspended by attachment to the sidewall portion 18 of the container 12 or by supports that extend from the lower surface 104 of the baffle 52 and rest on or are coupled to the bottom portion 16 of the container 12. In these embodiments, removal of the lid 68 exposes the upper surface 86 of the baffle 52 for inspection. For embodiments where the upper surface 86 defines a concavity and that include a drain aperture 102, the fill mark 162 can be made on the upper surface 86 of the baffle indicating the desired level for the water fill level 128. The baffle 52 is depicted with the fill mark 162 in FIG. 7.

Various embodiments can include a set of operating instructions presented on a tangible medium (e.g., a non-transitory computer-readable medium such as a compact disc, digital video disk, or a server device on the internet, and/or written on paper) that is provided with the portable vacuuming device 10, 150. The operating instructions can comprise one or more of the following steps:

- removing the lid 68 from the sidewall portion 18 of the container 12;
- depositing water 122 in the container 12 to the fill level 128 established by the fill mark 162;
- replacing the lid 68 on the sidewall portion 18 of the container 12;
- connecting the vacuum hose 26 to the vacuum inlet line 24;
- connecting the eductor suction source 34 to a compressed air source (or alternatively connecting a remote suction source to the container 12); and/or
- initiating a flow of compressed air to the eductor suction source 120 to cause a pressure within the interior chamber 22 of the container 12 to become sub-atmospheric.

Figure 8A:
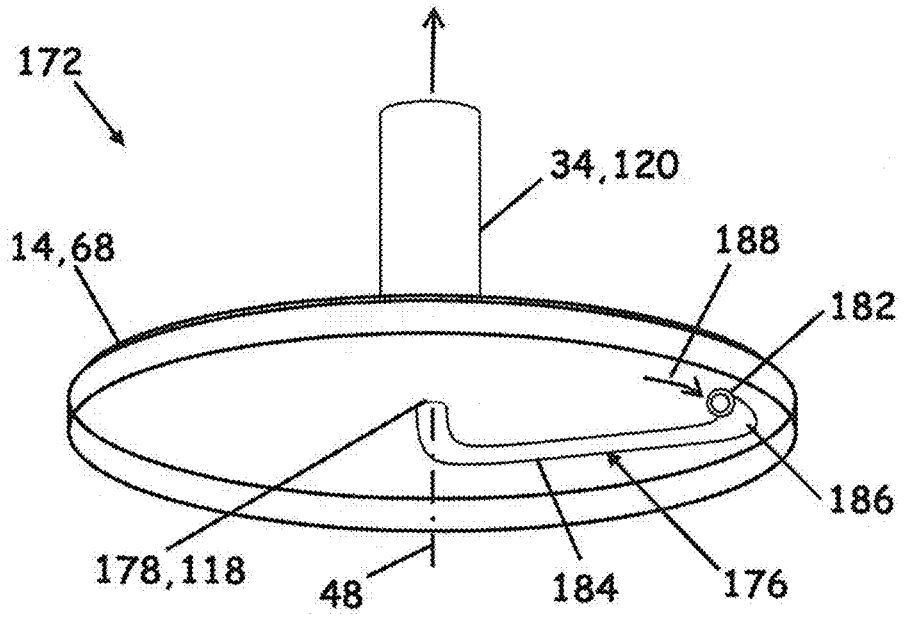
FIGS. 8A and 8B are bottom perspective views of top portions of portable vacuuming devices having interior suction conduits in embodiments of the disclosure.
Figure 8B:
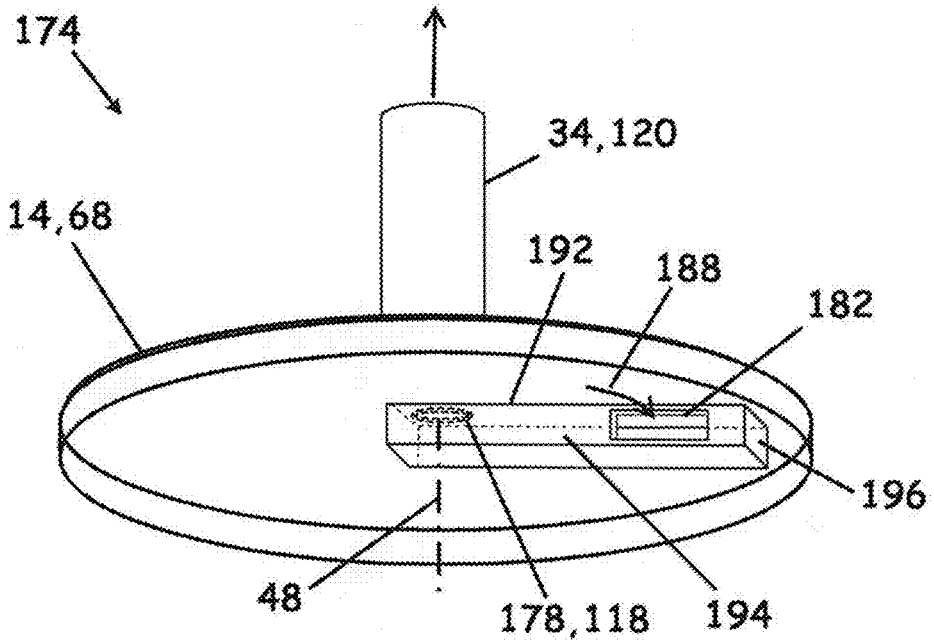

Referring to FIGS. 8A and 8B, top portions 172 and 174, each having an interior suction conduit 176, are depicted in an embodiment of the disclosure. The interior suction conduits 176 can include an outlet 178 that is in fluid communication with the suction source 34 via the suction port 118, and an inlet 182 that is radially offset from the central axis 48 of the container 12. In various embodiments, the interior suction conduit 176 includes a line 184 that is shaped to extend radially outward from the central axis 48 proximate the top portion 172 with an elbow 186 at the inlet 182 that orients the inlet 182 so that flow normal to the inlet includes a tangential component 188 (FIG. 8A). In other embodiments, the interior suction conduit 176 comprises a duct 192 with the inlet 182 disposed on a tangential face 194 proximate a radially distal end 196 of the duct 192 so that flow normal to the inlet 182 includes the tangential component 188 (FIG. 8B). In one embodiment, the top portion 174 serves as the upper flow boundary of the duct 192.

Functionally, the interior suction conduit 176 can augment the rotating air flow 132 in the upper chamber 54 of the container 12. That is, the inlet 182 to the interior suction conduit 176, facing at least somewhat tangentially, causes the an being evacuated to the an proximate the top portion of the container to have the tangential component 188, thereby imposing a rotational flow about the central axis 48. The rotational flow generated by the interior suction conduit 176 can augment the rotational flow imposed by the rotating air/water interface at the lower portion of the upper chamber 54, particularly when rotational air flows in the upper chamber 54 and the lower chamber 56 are in the same rotational direction about the central axis 48. The augmentation can enhance the centrifugal forces on the mist droplets 114 and particles suspended in the upper chamber 54, thereby further enhancing the neutralizing effect that the centrifugal forces provide.

Each of the additional figures and methods disclosed herein can be used separately, or in conjunction with other features and methods, to provide improved containers and methods for making and using the same. Therefore, combinations of features and methods disclosed herein may not be necessary to practice the disclosure in its broadest sense and are instead disclosed merely to particularly describe representative and preferred embodiments.

Various modifications to the embodiments may be apparent to one of skill in the art upon reading this disclosure. For example, persons of ordinary skill in the relevant art will recognize that the various features described for the different embodiments can be suitably combined, uncombined, and re-combined with other features, alone, or in different combinations. Likewise, the various features described above should all be regarded as example embodiments, rather than limitations to the scope or spirit of the disclosure.

Persons of ordinary skill in the relevant arts will recognize that various embodiments can comprise fewer features than illustrated in any individual embodiment described above. The embodiments described herein are not meant to be an exhaustive presentation of the ways in which the various features may be combined. Accordingly, the embodiments are not mutually exclusive combinations of features; rather, the claims can comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

References to "embodiment(s)", "disclosure", "present disclosure", "embodiment(s) of the disclosure", "disclosed embodiment(s)", and the like contained herein refer to the specification (text, including the claims, and figures) of this patent application that are not admitted prior art.

For purposes of interpreting the claims, it is expressly intended that the provisions of 35 U.S.C. 112(f) are not to be invoked unless the specific terms "means for" or "step for" are recited in the respective claim.

What is claimed is:

1. A portable vacuuming device for neutralizing flammable powders, comprising:

a container including a top portion, a bottom portion, and a sidewall portion that separates said top portion and said bottom portion, said sidewall portion extending upwards from said bottom portion to define an opening and said top portion comprising a lid that forms a closure over said opening, said container defining an interior chamber;

a baffle disposed in said container that defines an upper chamber between said top portion and said baffle and defines a lower chamber between said bottom portion and said baffle, said baffle depending from said lid and suspended over said bottom portion of said container, said baffle including a peripheral edge being radially inset from said sidewall portion to define a substantially uniform annular gap between an interior surface of said sidewall portion and said peripheral edge, wherein an annular volume extends axially along an interior surface of said sidewall portion, said annular volume having a substantially uniform annular width defined by said annular gap, at least a portion of said annular volume extending unobstructed from said bottom portion into said upper chamber of said container;

a vacuum inlet line in fluid communication with said interior chamber, said vacuum inlet line defining an egress port, said egress port being disposed between said baffle and said bottom portion of said container, said egress port being arranged for generation of a tangential flow component that is parallel to a face of said sidewall portion; and a suction source in fluid communication with said interior chamber of said container.

2. The vacuuming device of claim 1, wherein an upper surface of said baffle defines a concavity.

3. The vacuuming device of claim 2, wherein said concavity defines a funnel having a mouth at an upper end and a drain aperture at a lower end.

4. The vacuuming device of claim 3, wherein said funnel substantially outlines an inverted conical geometry having a base at said upper end and an apex at said lower end.

5. The vacuuming device of claim 4, wherein said outline of said inverted conical geometry is truncated proximate said apex to define said drain aperture.

6. The vacuuming device of claim 1, wherein said container is a drum.

7. The vacuuming device of claim 6, wherein said drum has a capacity between 1 gallon to 70 gallons inclusive.

8. The vacuuming device of claim 7, wherein said drum has a capacity between 2 gallons to 55 gallons inclusive.

9. The vacuuming device of claim 8, wherein said drum has a capacity between 5 gallons to 40 gallons inclusive.

10. The vacuuming device of claim 1, wherein said container is operatively coupled to a plurality of casters.

11. The vacuuming device of claim 1, wherein said suction source is coupled with an interior suction conduit that extends into said interior chamber, said interior suction conduit defining an inlet port, said interior suction conduit being arranged with said inlet port being proximate said sidewall portion of said container, wherein a vector normal to said inlet port includes a tangential component parallel to an inner surface of said sidewall portion.

12. The vacuuming device of claim 1, wherein said vacuum inlet line passes through said top portion and said baffle.

13. The vacuuming device of claim 12, wherein said baffle depends from said top portion by connection to said vacuum inlet line.

14. The vacuuming device of claim 1, wherein said suction source comprises an eductor.

15. The vacuuming device of claim 1, wherein said vacuum inlet line includes an ingress port coupled to a vacuum hose.

16. The vacuuming device of claim 15, wherein said top portion, said baffle, said vacuum inlet line, and said vacuum hose are electrically conductive and are at a uniform electrical potential.

17. The vacuuming device of claim 1, wherein said vacuuming device is portable.

18. The vacuuming device of claim 1, wherein said sidewall portion is translucent.

19. The vacuuming device of claim 1, wherein said portion of said annular volume extends unobstructed from said bottom portion to said lid of said top portion.

20. A method for neutralizing flammable powders, comprising:

providing a vacuuming device including a container having a top portion, a bottom portion, and a sidewall portion that separates said top portion and said bottom portion, and having an upper chamber and a lower chamber separated by a baffle, said upper chamber and said lower chamber being in fluid communication proximate a peripheral edge that is radially inset from said sidewall portion to define a substantially uniform annular gap between an interior surface of said sidewall portion and said peripheral edge, said lower chamber being in fluid communication with a vacuum inlet line that defines an egress port disposed in said lower chamber, said egress port being arranged for generation of a tangential flow along an interior face of said lower chamber;

providing operating instructions on a tangible medium, said operating instructions including:

disposing a liquid in said container prior to operation to a level below said annular gap; and causing said container to run at sub-atmospheric pressure, wherein the step of causing said container to run at sub-atmospheric pressure draws a gas stream into said lower chamber of said container to generate an air jet having a tangential flow component that is parallel said interior face of said lower chamber, said tangential flow component causing said liquid to rotate within said lower chamber such that said liquid forms a concave shape having a raised edge along an interior circumference of said sidewall portion raised into said annular gap.

* * * * *